United States Patent [19]

Starke et al.

[11] Patent Number: 4,775,295

[45] Date of Patent: Oct. 4, 1988

[54] CENTRIFUGAL PUMP CASING

[75] Inventors: Jörg Starke, Eppelsheim; Rolf Scherer, Hessheim, both of Fed. Rep. of Germany; Renzo Ghiotto; Primo Lovisetto, both of Vicenza, Italy

[73] Assignees: Klein, Schanzlin & Becker Aktiengesellschaft, Frankenthal/Pfalz, Fed. Rep. of Germany; Lowara S.p.A., Vicenza, Italy

[21] Appl. No.: 25,152

[22] PCT Filed: May 9, 1986

[86] PCT No.: PCT/DE86/00188

§ 371 Date: Feb. 24, 1987

§ 102(e) Date: Feb. 24, 1987

[87] PCT Pub. No.: WO86/06800

PCT Pub. Date: Nov. 20, 1986

[30] Foreign Application Priority Data

May 17, 1985 [DE] Fed. Rep. of Germany ..... 3517827
May 13, 1986 [CA] Canada ..... 509011

[51] Int. Cl.[4] ..... F01D 25/16

[52] U.S. Cl. ..... 415/219 C; 415/219 R

[58] Field of Search ..... 415/201, 219 R, 219 C; 416/DIG. 3

[56] References Cited

U.S. PATENT DOCUMENTS

| | | | |
|---|---|---|---|
| 1,707,719 | 4/1929 | Goldthwaite | 415/219 C |
| 2,805,615 | 9/1957 | Rudy | 415/219 C |
| 2,844,100 | 7/1958 | Heinecke | 103/87 |
| 2,916,997 | 12/1959 | Terrie | 415/206 |
| 3,523,743 | 8/1970 | Jolette | 415/219 C |
| 3,746,465 | 7/1973 | Van Dorn et al. | 415/213 R |
| 4,288,202 | 9/1981 | Buckmann | 415/206 |

FOREIGN PATENT DOCUMENTS

| | | | |
|---|---|---|---|
| 2010434 | 7/1979 | United Kingdom . | |
| 2070688 | 9/1981 | United Kingdom | 415/219 R |

*Primary Examiner*—Larry I. Schwartz
*Attorney, Agent, or Firm*—Peter K. Kontler

[57] ABSTRACT

The subject of the invention is a casing jacket for centrifugal pumps in which the suction side connecting flange is integrated in the casing jacket and the actual suction nozzle is located inside the casing jacket. A high degree of pressure resistance is obtained by embossed, corrugation-like spaces for the suction side flange connecting means and a corresponding curved or spherical outer contour of the casing jacket.

7 Claims, 6 Drawing Sheets

CENTRIFUGAL PUMP CASING

BACKGROUND OF THE INVENTION

The invention relates to a centrifugal pump casing.

Centrifugal pump casings of the type to which the invention pertains are externally loaded by forces due to piping and are also subjected to high internal pressures.

OBJECTS AND SUMMARY OF THE INVENTION

It is an object of the invention to provide a centrifugal pump casing of sheet material which remains stable under the influence of high internal pressures.

The object is accomplished in that the casing comprises a one-piece or multiple-section sheet-metal jacket and a flange which is located at the suction side of the case and is integral with the jacket. The jacket has a plurality of corrugations in the region of the bores for the flange screw joint.

Integration of the suction side connecting flange in the casing jacket according to the invention results in a spherical or arcuate configuration of the pressure-absorbing casing between the pressure side fastening flange and the connection to the suction line. This yields a casing which is well-protected against deformation. The corrugation-like spaces, which are required for the mounting of the flange connecting screws, produce additional reinforcement of the casing jacket.

In one embodiment of the invention, the corrugation-like spaces are provided with disc-like abutments in the region of the suction side connecting flange. This embodiment is used in those cases where the nuts of the flange screw joints are disposed in these corrugation-like spaces. The abutments then allow the flange of the suction line and that of the suction nozzle integrated in the casing jacket to be connected with one another.

Another embodiment of the invention provides for a separate annular flange to be connected with the casing jacket in the region of the suction side connecting flange. The casing jacket here has a shoulder next to the corrugation-like spaces for the flange screw joint, and an annular flange lies flush against the shoulder and is fixed to the casing jacket. This annular flange, which can likewise be in the form of a discrete sheet material part, effects further reinforcement of the casing jacket.

In accordance with a further embodiment of the invention, the casing jacket is provided with an insert which constitutes the suction nozzle and forms a split seal with the impeller. This insert, which may, for example, be introduced into the casing jacket from the pressure side, can be manufactured as a simple tubular part. Depending upon its design, it can cooperate directly with the suction mount of the impeller to thus form a split seal or it receives an appropriately configurated split ring which cooperates with the suction mouth of the impeller.

According to yet another embodiment of the invention, the casing jacket is provided with a one-piece or multiple section insert which constitutes the suction nozzle and/or the suction side lateral impeller chamber. This can improve the hydraulic characteristics inside the casing jacket and also makes it possible to obtain additional reinforcement of the casing jacket.

A further embodiment of the invention, in which reinforcing means are arranged inside the casing between the suction nozzle and the space surrounding the suction nozzle, functions in this manner. The reinforcing means can be appropriately configurated shaped sheet material parts which, for example, extend between the region of the split ring and the corrugation-like spaces. The space which is inside the casing jacket and surrounds the suction nozzle can equally well be filled with appropriate sealing materials. These can be metallic. However, it is also possible to use appropriate synthetic resins.

DESCRIPTION OF THE PREFERRED EMBODIMENTS

Figure 1:
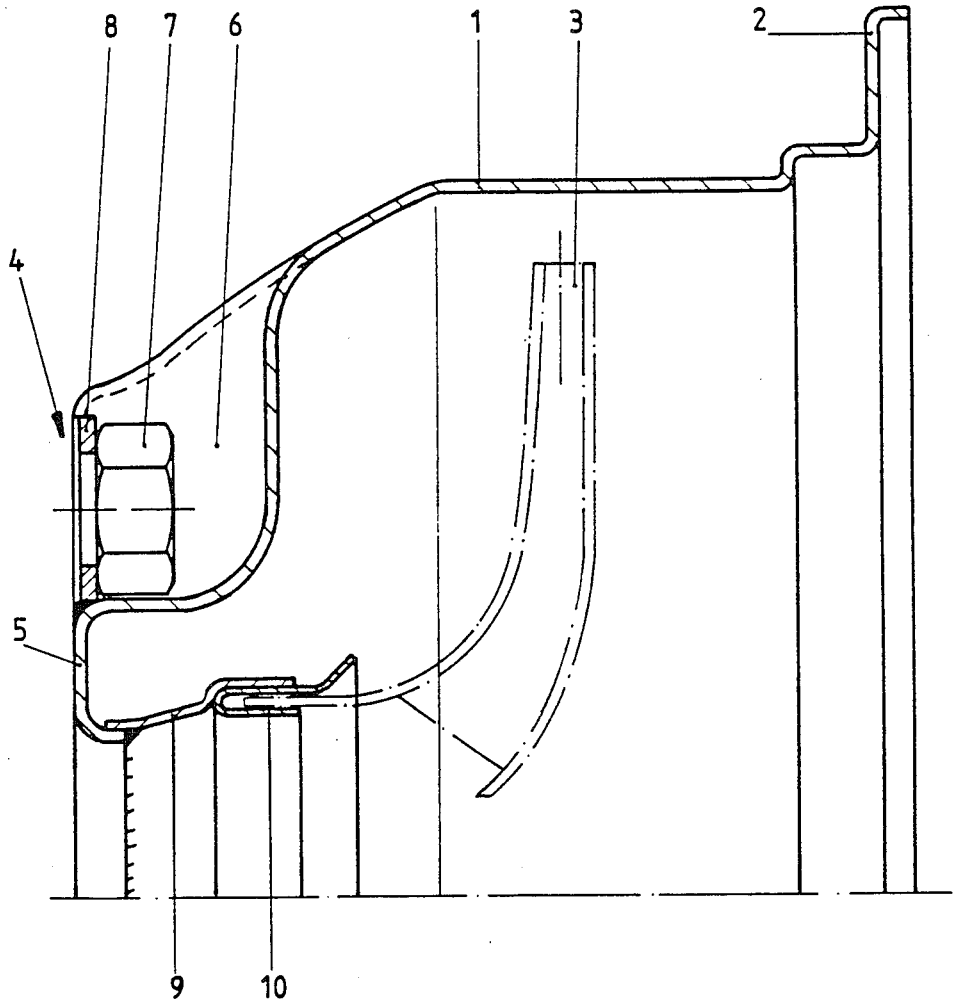
FIGS. 1 thru 3 show a casing jacket having corrugation-like spaces provided with abutments.

The casing jacket 1 is provided, on the pressure side, with a fastening flange 2 which connects the casing jacket with a non-illustrated floor stand or block motor. A radial impeller 3 is shown inside the casing jacket. The casing jacket 1 extends from the pressure side fastening flange 2 to the suction side connecting flange 4 in an approximately arcuate fashion. The suction side connecting flange 4 is formed with a sealing surface 5 above which corrugation-like spaces 6 are embossed in the casing jacket. In this exemplary embodiment, the corrugation-like spaces 6 accommodate nuts 7 for non-illustrated flange screws. The spaces have a size which allows the nuts 7 to be held by an appropriate tool. For the absorption of forces, a disc-like abutment 8 is welded in each space 6 in the region of the nuts 7. The suction nozzle 9 which, by virtue of this design, is located inside the casing jacket 1, is provided with a split ring 10 into which the suction mount of the impeller 3 extends. In this example, the casing jacket 1 is in the form of a one-piece shaped material part which includes the flange sealing surface 5.

Figure 2:
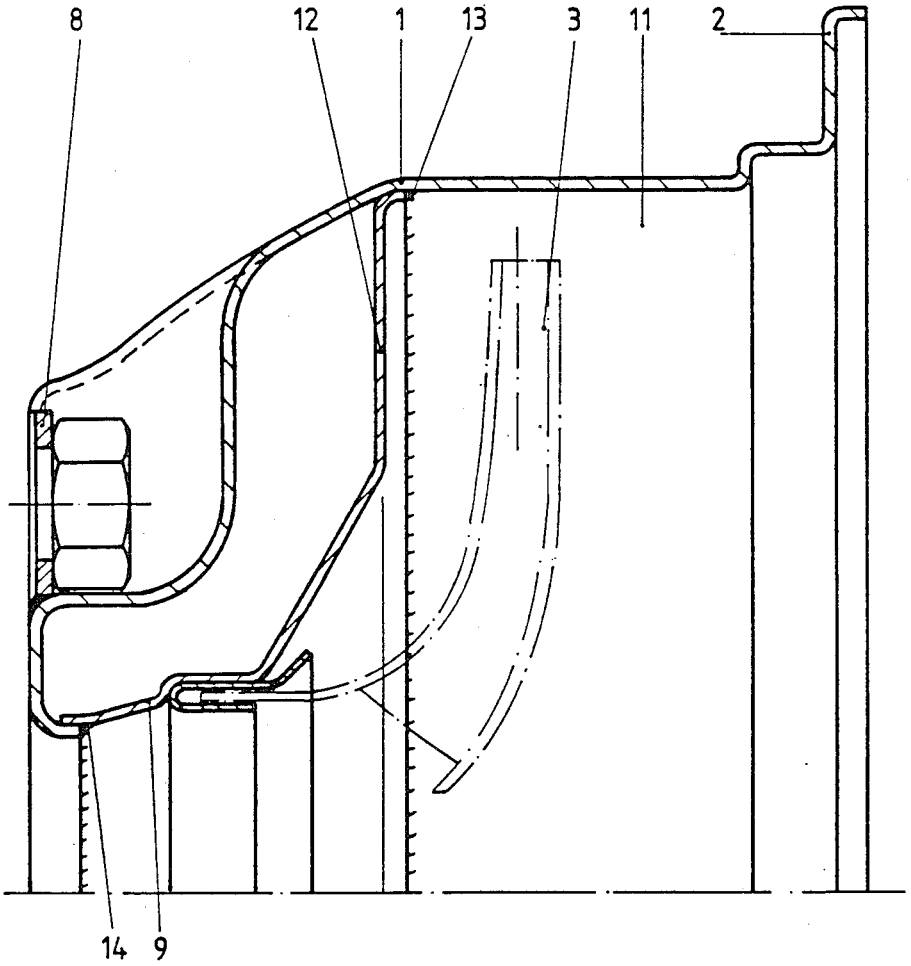

In contrast to FIG. 1, FIG. 2 illustrates a suction nozzle 9 which, for improvement of the hydraulic characteristics inside the pressure chamber 11, is formed of one piece with an insert 12 serving to reduce the size of the suction side lateral impeller chamber. This insert can be introduced into the casing from the pressure side without difficulty and connected to the casing jacket 1 at the outer and inner periphery by weld seams 13,14. Appropriately positioned spot welds may likewise be used.

Figure 3:
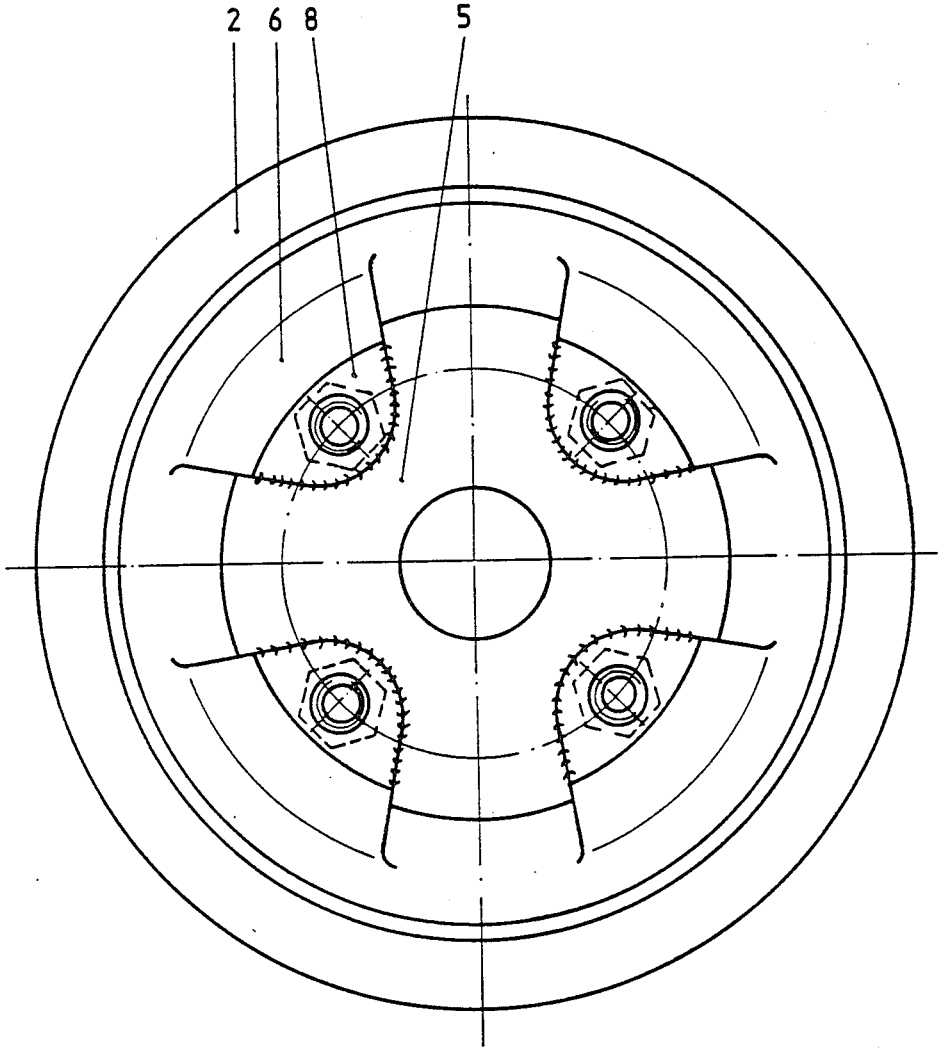

FIG. 3 is a front view of the casing jacket according to the invention and shows how the disc-like abutments 8 close the corrugation-like spaces 6 in the region of the fastening nuts 7.

Figure 4:
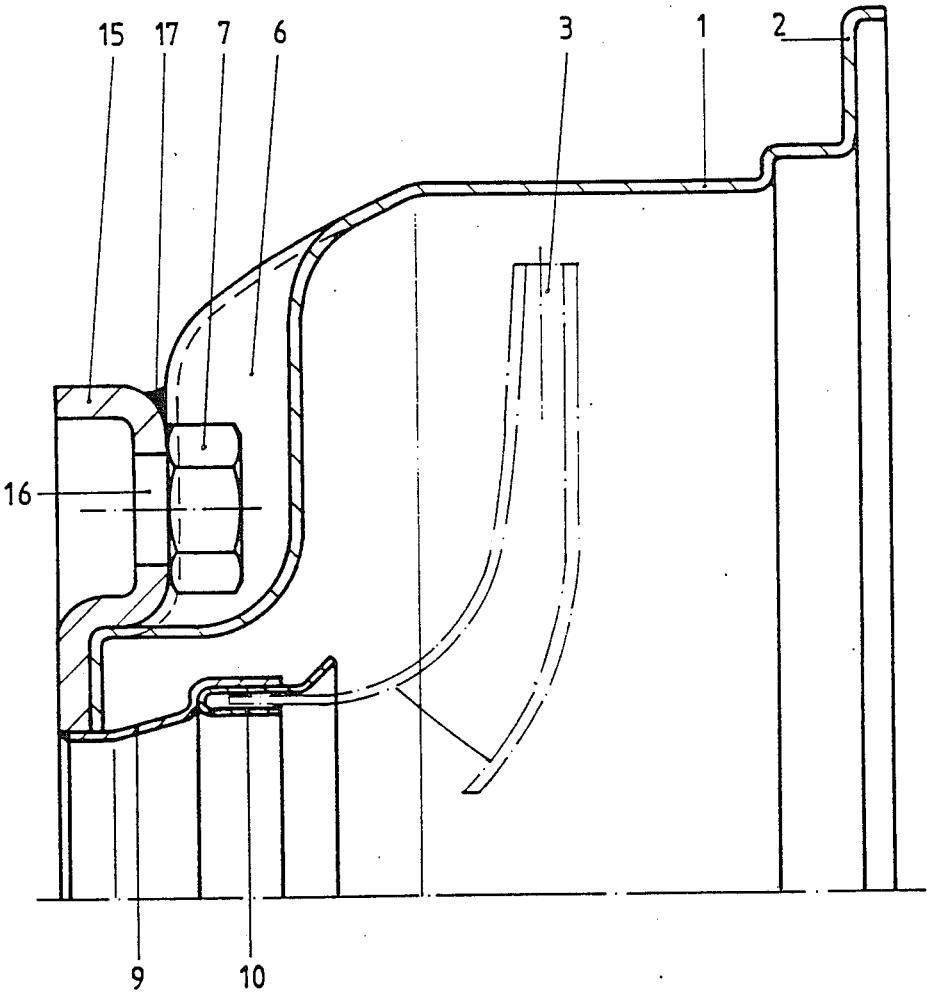
FIGS. 4 thru 6 show a casing jacket provided with an annular flange.

FIG. 4 illustrates a casing jacket 1 in which the suction side connecting flange is formed by a separate annular flange 15 which lies flush against the casing jacket 1 with its rear surface. The nuts 7 shown here are located in the corrugation-like spaces 6 in the region of the fastening bores 16 for the flange screw joint. The annular flange 15 can be fixed to the casing jacket 1 by a circumferentially extending weld seam 17 or appropriately positioned spot welds. Depending upon material thickness, additional reinforcement of the entire casing is achieved. The suction nozzle 9 is again in the form of a discrete, simple tubular part provided with a split ring 10.

Figure 5:
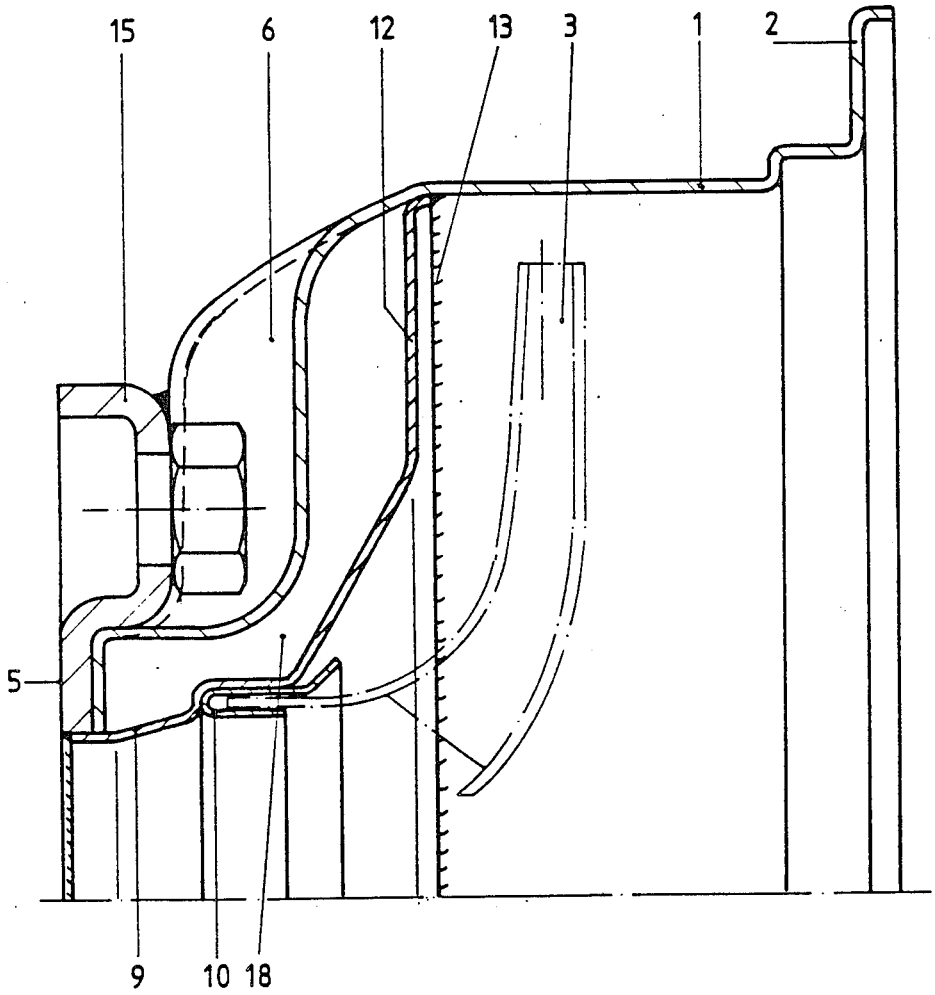

FIG. 5 shows a modification of FIG. 4 which, similarly to the embodiment of FIG. 2, includes an insert 12 of one piece with the suction nozzle 9 and serving to reduce the size of the lateral impeller chamber. To reinforce the suction side region of the casing jacket, it is possible to provide the space 18 which surrounds the suction nozzle 9 with additional reinforcing means. These can be supporting elements which are not illustrated here and connect the region of the corrugation-like spaces 6 located inside the casing jacket 1 with the region of the split ring 10. It is equally possible to employ a filling of an appropriate, stiff sealing mass which improves the pressure resistance of the casing. Due to the arcuate contour from the pressure side fastening flange 2 of the casing jacket 1 to the region of the suction side connecting flange, this casing is extremely resistant to internal as well as external pressure.

Figure 6:
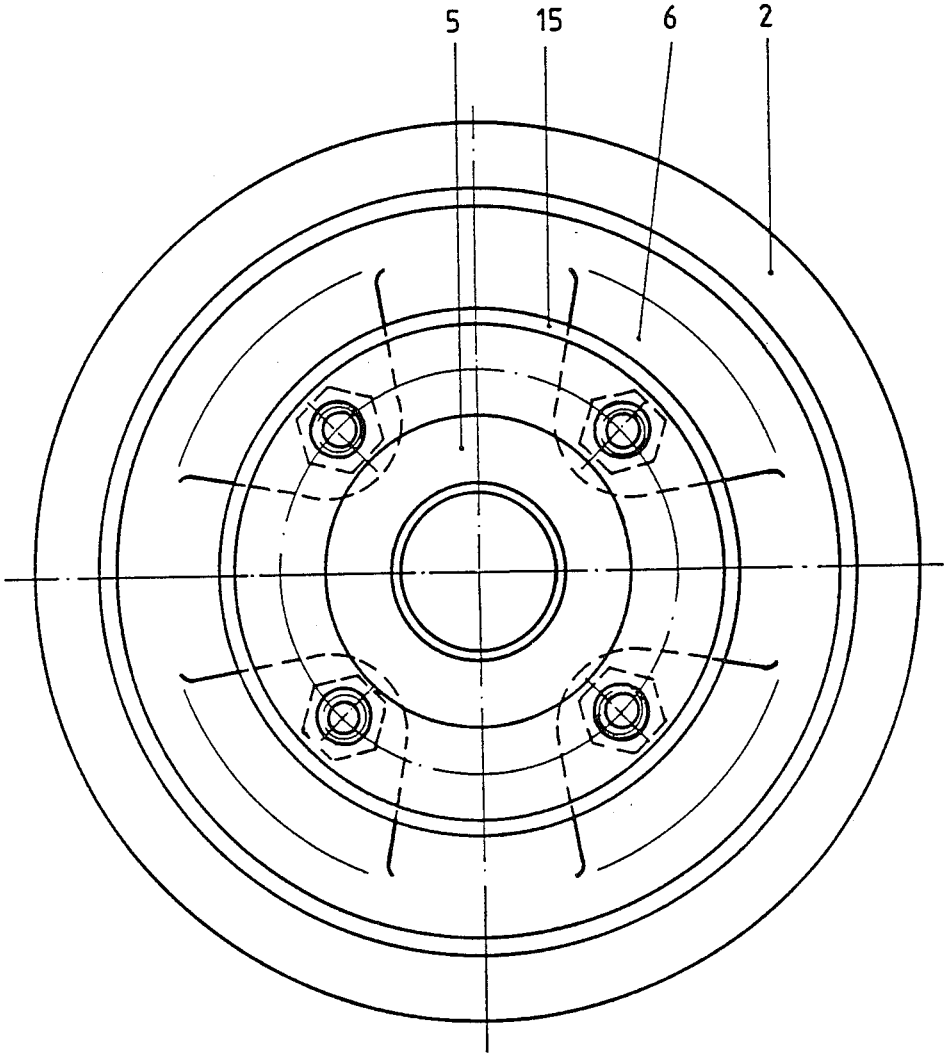

FIG. 6 is again a front view of the casing jacket 1 similar to that of FIG. 3 and shows how the annular flange 15 in the region of the corrugation-like spaces 6 serves as an abutment for the nuts 7. By virtue of the fact that the annular flange 15 lies flush against the casing jacket 1, the annular flange 15 becomes a supporting component of the casing.

The arcuate contour of the casing jacket 1, which may be spherical, conical or a combination of the same as illustrated in the exemplary embodiments, has a very high resistance to the pressures which may be generated.

We claim:

1. A centrifugal pump casing having a suction side and a pressure side and comprising a deformation-resistant hollow jacket consisting of sheet metal and having means for fastening it to a support at the pressure side of the casing, said jacket further having a plurality of reinforcing corrugations at the suction side of the casing; a connecting flange rigid with said jacket in the region of said corrugations; and means for connecting said jacket to a suction line, including fastener means provided at said corrugations, said corrugations having holes for said fastener means.

2. The casing of claim 1, wherein said corrugations have abutments in the region of said flange.

3. The casing of claim 1, further comprising means for rigidly securing said flange to said jacket.

4. The casing of claim 1, further comprising an insert provided in and affixed to said jacket and including a suction nozzle in the region of said flange, an impeller in said jacket, and a split seal provided between said impeller and said nozzle.

5. The casing of claim 1, wherein said jacket includes a portion constituting a suction nozzle at the suction side of the casing.

6. The casing of claim 1, wherein said jacket includes a portion defining a lateral impeller chamber.

7. The casing of claim 1, wherein said jacket includes a suction nozzle at the suction side of the casing and defines a space surrounding said nozzle, and further comprising reinforcing means provided in said jacket between said nozzle and said space.

* * * * *